US009188334B2

(12) United States Patent
Mulberry

(10) Patent No.: US 9,188,334 B2
(45) Date of Patent: Nov. 17, 2015

(54) DUAL FUEL HEATER

(71) Applicant: Michael S Mulberry, Smyrna, GA (US)

(72) Inventor: Michael S Mulberry, Smyrna, GA (US)

(73) Assignee: Sure Heat Manufacturing, Inc., Kennesaw, GA (US)

( * ) Notice: Subject to any disclaimer, the term of this patent is extended or adjusted under 35 U.S.C. 154(b) by 475 days.

(21) Appl. No.: 13/659,596

(22) Filed: Oct. 24, 2012

(65) Prior Publication Data

US 2013/0101945 A1 Apr. 25, 2013

Related U.S. Application Data

(60) Provisional application No. 61/551,192, filed on Oct. 25, 2011.

(51) Int. Cl.
*F23C 1/00* (2006.01)
*F23Q 9/00* (2006.01)
*F24H 3/00* (2006.01)

(52) U.S. Cl.
CPC ... *F23Q 9/00* (2013.01); *F23C 1/00* (2013.01); *F24H 3/00* (2013.01)

(58) Field of Classification Search
CPC ..... F23N 2037/08; F23C 1/00; F24C 1/02
USPC ..... 431/12, 278, 280, 281
See application file for complete search history.

(56) References Cited

U.S. PATENT DOCUMENTS

2007/0266765 A1* 11/2007 Deng ..... 73/23.2
2007/0277803 A1* 12/2007 Deng ..... 126/92 AC
2007/0277812 A1* 12/2007 Deng ..... 126/92 AC
2007/0277813 A1* 12/2007 Deng ..... 126/92 R
2008/0149871 A1* 6/2008 Deng ..... 251/142
2008/0149872 A1* 6/2008 Deng ..... 251/142
2008/0153044 A1* 6/2008 Deng ..... 431/74
2008/0153045 A1* 6/2008 Deng ..... 431/76
2008/0223465 A1* 9/2008 Deng ..... 137/625.4
2008/0227045 A1* 9/2008 Deng ..... 431/354
2009/0139304 A1* 6/2009 Deng ..... 73/23.2
2010/0035196 A1* 2/2010 Deng ..... 431/278
2010/0037884 A1* 2/2010 Deng ..... 126/116 A
2010/0095945 A1* 4/2010 Manning ..... 126/116 R
2010/0170503 A1* 7/2010 Deng ..... 126/85 R
2010/0304317 A1* 12/2010 Deng ..... 431/75
2010/0326430 A1* 12/2010 Deng ..... 126/85 R
2010/0330513 A1* 12/2010 Deng ..... 431/12
2010/0330518 A1* 12/2010 Deng ..... 431/159
2010/0330519 A1* 12/2010 Deng ..... 431/281
2011/0081620 A1* 4/2011 Deng ..... 431/258
2011/0143294 A1* 6/2011 Deng ..... 431/279
2011/0247607 A1* 10/2011 Streisel et al. ..... 126/85 R (Continued)

*Primary Examiner* — Jorge Pereiro
(74) *Attorney, Agent, or Firm* — Baker Donelson; Dorian B. Kennedy

(57) ABSTRACT

A dual fuel heater (10) includes a pressure regulator converter (11) in fluid communication with a control valve (21), which in turn is in fluid communication with a selector valve (40) through a NG/LP pilot line (48) having a splitter (49) to form a NG pilot line (50) and a LP pilot line (51) extending to an LP pilot nozzle (67). The selector valve is moveable between an NG "on" position wherein fuel entering the selector valve passes to a burner (60) and to a NG pilot nozzle (65), and an NG "off" position (LP "on" position) wherein fuel passes to the burner and not to either the NG pilot nozzle or the LP pilot nozzle. The NG pilot nozzle is oriented so that its flame heats the first thermocouple associated with the NG pilot nozzle and ignites fuel expelled from the LP pilot nozzle.

11 Claims, 2 Drawing Sheets

(56) References Cited

U.S. PATENT DOCUMENTS

| | | | | |
|---|---|---|---|---|
| 2011/0290229 | A1* | 12/2011 | Manning | 126/116 A |
| 2012/0006091 | A1* | 1/2012 | Deng | 73/23.2 |
| 2012/0012097 | A1* | 1/2012 | Deng | 126/344 |
| 2012/0012099 | A1* | 1/2012 | Deng | 126/512 |
| 2012/0012103 | A1* | 1/2012 | Deng | 126/85 R |
| 2012/0045726 | A1* | 2/2012 | Mateos Martin et al. | 431/89 |
| 2012/0067341 | A1* | 3/2012 | Mateos Martin | 126/85 R |
| 2012/0132189 | A1* | 5/2012 | Deng | 126/58 |
| 2012/0145693 | A1* | 6/2012 | Deng | 219/201 |
| 2012/0196236 | A1* | 8/2012 | Deng | 431/285 |
| 2012/0255536 | A1* | 10/2012 | Deng | 126/58 |
| 2013/0037014 | A1* | 2/2013 | Deng | 126/116 R |
| 2013/0098349 | A1* | 4/2013 | Deng | 126/58 |
| 2013/0122439 | A1* | 5/2013 | Deng | 431/280 |
| 2013/0149652 | A1* | 6/2013 | Deng | 431/278 |
| 2013/0186492 | A1* | 7/2013 | Deng | 137/624.27 |
| 2013/0209944 | A1* | 8/2013 | Deng | 431/6 |
| 2013/0273482 | A1* | 10/2013 | Mateos Martin | 431/75 |
| 2014/0299123 | A1* | 10/2014 | Deng | 126/85 R |

* cited by examiner

DUAL FUEL HEATER

REFERENCE TO RELATED APPLICATION

Applicant claims the benefit of U.S. Provisional Patent Application Ser. No. 61/551,192 filed Oct. 25, 2011.

TECHNICAL FIELD

This invention relates generally to heaters, and more particularly to heaters having dual fuel capabilities.

BACKGROUND OF THE INVENTION

Heaters may come in the form of space heaters, fireplace inserts, wall heaters, or the like. These heaters utilize a combustible fuel such as natural use (NG) or liquid petroleum (LP). Because each of these fuels is released at different pressures, the heater is usually designed to operate on one fuel or the other.

Recently, heaters have been designed which may operate on both natural gas or liquid petroleum. These heaters require that the user "set up" the device for each of the two fuels in different manners, such as utilizing different gas regulators and nozzles to achieve the different pressures associated with each gas. The requirement that the system be set up differently for each gas in not only tedious, but also increases the possibility that one may set up the system in the wrong manner with potentially disastrous consequences.

Accordingly, it is seen that a need remains for a dual fuel heater which may quickly and easily be converted from on gas type set-up to another. It is to the provision of such therefore that the present invention is primarily directed.

SUMMARY OF INVENTION

In a preferred form of the invention a dual fuel heater comprises a regulator hay in a regulator fuel line inlet and a regulator fuel line outlet, a flow control valve having a control valve fuel line inlet in fluid communication with the regulator fuel line outlet, a control valve main line outlet, and a control valve pilot fuel line outlet. The dual fuel heater also has a fuel selector valve having a selector valve pilot fuel line inlet in communication with the control valve pilot fuel line out a selector valve main line inlet in fluid communication with the control valve main line outlet, a selector valve pilot line outlet, and a selector valve burner line outlet. The fuel selector valve is positionable between a first position wherein a first fuel is directed to the selector valve burner line outlet and the selector valve pilot line outlet and a second position wherein a second fuel is directed only to the selector valve burner line outlet. Lastly, the dual fuel heater includes a burner in fluid communication with the selector valve burner line outlet and burner pilot system. The burner pilot system has a first fuel oxygen depletion system which includes a first thermocouple and a first pilot nozzle in fluid communication with the selector valve pilot line outlet. The burner pilot system also has a second fuel oxygen depletion system including a second thermocouple and a second pilot nozzle in fluid communication the control valve pilot fuel line outlet. The second pilot nozzle is oriented to direct a flame to the second thermocouple. The first pilot nozzle is oriented to direct a flame to both the second thermocouple and the first thermocouple.

DETAILED DESCRIPTION

Figure 1:
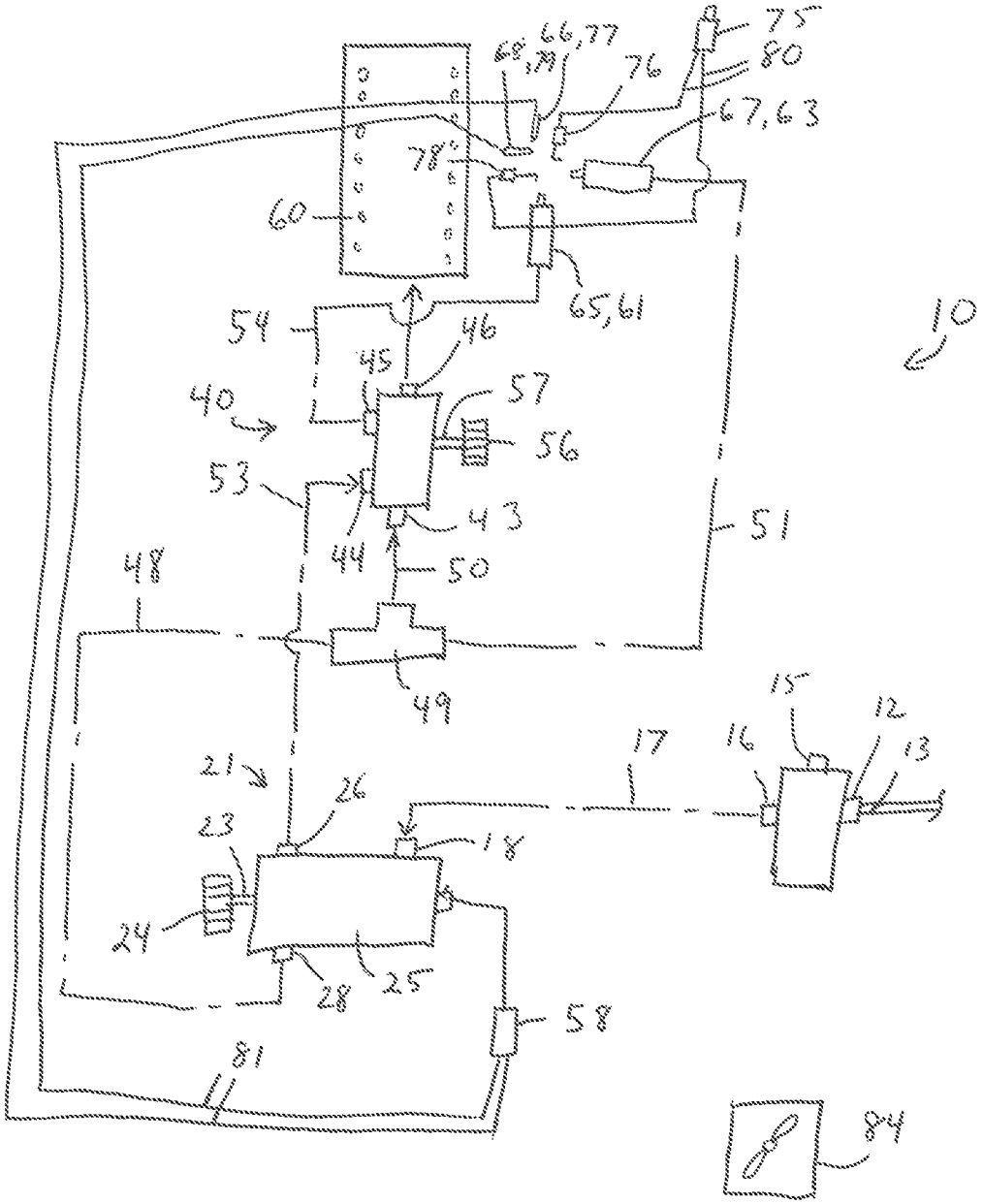
FIG. 1 is a schematic view of the dual fuel heater embodying principles of the invention in a preferred form.

With reference next to the drawings, there is shown a dual fuel heater 10 in a preferred form of the invention. The dual fuel heater 10 is in the form of a wall heater having an unshown conventional housing, however, it should be understood that the present invention relates to other types of heaters including, but not limited to, fireplace inserts and space heaters.

The dual fuel heater 10 has a main fuel pressure regulator converter 11 with a fluid inlet 12 which is adapted to be coupled with an external fuel supply line 13. The main regulator converter 11 has a convertible valve or valve stem. 15 the position of which controls the pressure at which the fluid exits the main regulator converter 11 through main line outlet 16 in fluid communication with a main line 17, i.e., with the valve 15 in a first position the fluid is expelled at the desired pressure for a first fuel, referenced hereinafter as natural gas or NG, while with the valve 15 in a second position the fluid is expelled at the desired pressure for a second fuel, referenced hereinafter as liquid petroleum or LP. The main line 17 is coupled to a fluid inlet 18 of a control valve 21.

The control valve 21 has a drive axle or spindle 23 having a control handle or knob 24 at one end. The control valve 21 has a manifold or body portion 25 with an NG/LP main line outlet 26 and an NG/LP pilot line outlet 28. The rotary position of the drive, spindle 23 controls the flow of fluid to the outlets 26 and 28, i.e., with the drive spindle 23 in a first, on position the NG/LP main line outlet 25 and NG/LP pilot line outlet 28 are opened. When with the drive axle 23 is in as second, "off" position the NG/LP main line out 26 and NG/LP pilot line outlet are closed so that no fuel is passing through the control valve. When the drive spindle 23 is in a third, "pilot" position the NG/LP main line outlet 26 is closed and the NG/LP pilot line outlet 28 is open.

The dual fuel heater 10 also include a selector valve 40 and a burner system 41. The selector valve 40 has an NG/LP pilot inlet 43, an NG/LP main inlet 44, an NG pilot line outlet 45, and an NG/LP burner outlet nozzle 46. The NG/LP pilot inlet 43 is in fluid communication with the control valve 21 through an NG/LP pilot line 48 which is bifurcated or split at a splitter 46 to form a first NG pilot line 50 and an LP pilot line 51. The first NG pilot line 50 is coupled to the NG/LP pilot inlet 43 of the selector valve 40. The NG/LP main inlet 44 is coupled to the control valve NG/LP main line outlet 26 through an NG/LP burner line 53. The NG pilot line outlet 45 is coupled to a second NG pilot line 54. The selector valve 40 is moveable between an NG "on" position wherein fluid entering the NG/LP main inlet 44 is allowed to pass to the NG/LP burner outlet nozzle 46 and fluid entering the NG/LP pilot inlet 43 is allowed to pass to the NG pilot line outlet 45, and an NG "off" position wherein fluid is allowed to pass to the NG/LP burner outlet nozzle but fluid entering the NG/LP pilot, inlet 43 is prevented from passing into the NG pilot line outlet 45. As such the selector valve turns the NG pilot line outlet "on or off" or "open and closed" depending on its position. The selector valve 40 has a manually actuateable knob 56 coupled to a rotary spindle 57 the position of which controls the on or "off" positions of the valve. The control valve 21 also includes a shut off valve coupled to a temperature sensor 58 which will actuate the shut off valve if the heater 10 overheats or otherwise reaches a predetermined threshold temperature level.

The burner system 41 includes an elongated burner 60 mounted adjacent the NC/LP burner outlet nozzle 46. The burner system 41 also includes a natural gas ODS set (oxygen depletion sensor) 61 in fluid communication with the selector valve NG pilot line outlet 45 through the second NG pilot line 54 and a liquid petroleum ODS set 63 in fluid communication with the LP pilot line 51. The natural gas ODS set 61 includes a natural gas nozzle 65 adapted for natural gas fuels and a natural gas ODS 66. Similarly, the liquid petroleum ODS set 63 includes a liquid petroleum gas nozzle 67 adapted for liquid petroleum fuels and a liquid petroleum ODS 68.

The dual fuel heater 10 also includes an ignition system 74 which includes an igniter switch 75, a natural gas or NG igniter 76, a natural as or NG thermocouple 77, a liquid petroleum or LP igniter 78, and a liquid petroleum or LP thermocouple 79. The igniter switch 75 is coupled to the natural gas igniter 76 and liquid petroleum igniter 78 through electrical conductors 80. The natural gas thermocouple 77 and liquid petroleum thermocouple 79 are coupled to the sensor 58 through electrical conductors 81 so that the non-existence of a flame shuts off the system by closing the control valve 21.

Lastly, the dual fuel heater 10 may include an electric fan 84 for inducing an airflow over the burner 60 and into the room to be heated.

Figure 2:
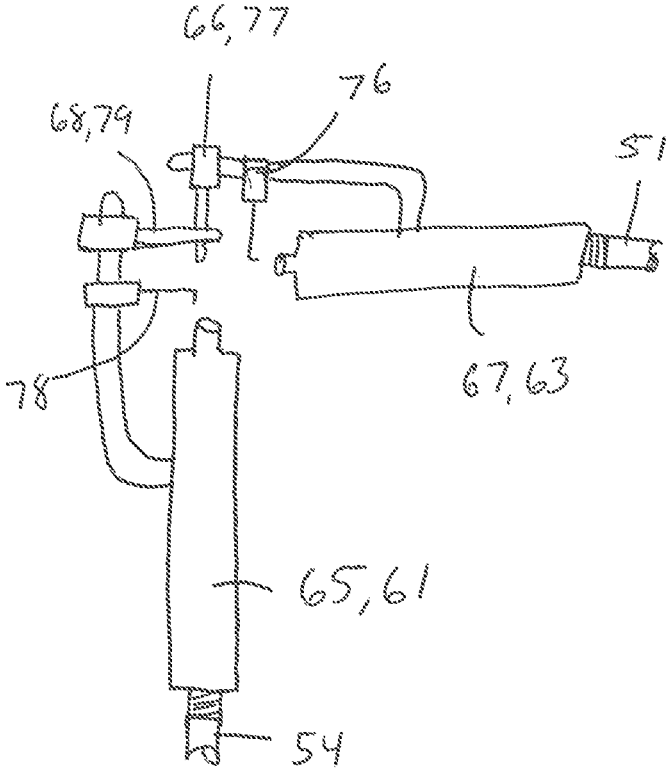
FIG. 2 is a schematic view of a portion of the dual fuel heater of FIG. 1.

As best illustrated in FIG. 2, the NG ODS set 61 is oriented generally perpendicular to that of the LP ODS set 63, the term perpendicular as used herein is not intended to mean only or strictly 90 degrees to each other but instead is intended to mean that they oriented generally normal to each other (including small variations) so that the flame from one set may easily ignite gas expelled from the other set. As the NG 005 as nozzle 65 create a large, long flame the orientation of the gas nozzle 65 creates a flame that encroaches upon the ignition area or normal flame area of the LP fluid expelled from the LP gas nozzle 67. As such, the long flame of the NG ODS insures that the flame associated with the LP ODS set 63 remains lit, even though the heater 10 may be configured to run on NG fuel, i.e., while set at NG fuel both the NG and the LP ODS systems are ignited and simultaneously operating, yet while set at LP fuel only the LP ODS system is ignited and operating. As such, the system is not operating in an "or" type condition wherein natural gas and liquid petroleum are selected to the exclusion of the other, i.e., operated by selecting either natural gas "or" liquid petroleum.

In use, the fuel supply line 13 is coupled to the fluid inlet 12 of the regulator converter 11. If the fuel being supplied to the dual fuel heater 10 through the fuel supply line 13 is natural gas (NG) the selector valve 40 is positioned in its NG or "on" position thereby allowing the flow of fluid from the NG/LP pilot inlet 43 to the NG pilot line outlet 45 where the fuel then travels to the NG ODS set NG gas nozzle 65. Fluid is also allowed to flow from the selector valve NG/LP main inlet 44 to the NG/LP burner outlet nozzle 46. If the control valve 21 is now positioned in its "pilot" position fluid will pass through the control valve 21, exit through the NG/LP pilot line outlet 28, through NG/LP pilot line 48, through splitter 49, through first NG pilot line 50, through selector valve 40, through NG pilot line outlet 45 through second NG pilot line 54 to NG ODS set 61, and through LP pilot line 51 to LP ODS set 63 for ignition. As such, the fluid is flowing to both the NG ODS and the LP ODS nozzles 65 and 67. With the NG ODS nozzle creating a large flame this NG flames insures that the LP flame from the LP ODS nozzle remains lit, at all times. While in the "pilot" position fluid is prevented from flowing out of the selector valve to the NG/LP burner outlet nozzle 46. With the control valve 21 moved to its "on" position the flow of the fluids remain as just described but the fluid also flows from NG/LP main line outlet 26, through NG/LP burner line 53, through selector valve 40 and through NG/LP burner outlet nozzle 46 for ignition by the pilot flame for burning within burner 60, i.e., both the NG and the LP ODS systems are ignited and burning fuel.

If the fuel being supplied to the dual fuel heater 10 through the fuel supply line 13 is liquid petroleum the selector valve 40 is positioned in its LP or NG "off" position thereby preventing the flow of fluid from the NG/LP pilot inlet 43 to the NG pilot line outlet 45 so that fuel cannot travel to the NG ODS set NG as nozzle 65. Fluid is allowed to flow from the selector valve NG/LP main inlet 44 to the NG/LP burner outlet nozzle 46. If the control valve 21 is positioned in its "pilot" position fluid passes through the control valve 21, exits through the NG/LP pilot line outlet 28, through NG/LP pilot line 48, through splitter 49, through first NG pilot line 50 where it is then prevented from flowing to the NG pilot line outlet 45 and NG/LP burner outlet nozzle 46, and flows through LP pilot line 51 to LP ODS set 63 for ignition. As such, the fluid is flowing to only the LP ODS nozzles 67. While in the "pilot" position fluid is prevented from flowing out of the selector valve to the NG/LP burner outlet nozzle 46. With the control valve 21 moved to its "on" position the flow of the fluids remain as just described but the fluid also flows from NG/LP main line outlet 26, through NG/LP burner line 53, through selector valve 40 and through NG/LP burner outlet nozzle 46 for ignition by the pilot flame for burning within burner 60. As such, the LG ODS system is ignited but the NG ODS system is not ignited.

It should be understood that as an option, a heat shield 84 may be positioned between the NG gas nozzle 65 and the LP thermocouple 79 so that the NG gas flame is not directed to, and therefore does not heat, the LP thermocouple 79.

It should be understood that the ODS systems work in conventional fashion, wherein the ignition of the pilot light of the ODS sets heat the thermocouple, a current is generated in the thermocouple which signals the control valve 21 through the sensor 58. If the pilot light goes out or is disturbed, the signal is reduced or terminated and the control valve 21 shuts off the flow of fuel exiting the flow control valve.

It should be understood that the term fluid and fuel are used herein to refer to both gases, liquids, and/or a combination thereof. It should be understood that the term line may be used interchangeable with pipe, conduit, tube or other similar structure intended to convey fluids therethrough.

It thus is seen that a dual fuel heater is now provided which may be quickly and easily switched from one fuel source to another. While this invention has been described in detail with particular reference to the preferred embodiment thereof, it should be understood that many modification, additions and deletions, may be made thereto without departure from the spirit and scope of the invention as set forth in the following claims.

The invention claimed is:

1. A dual fuel heater comprising:

a flow control valve;

a burner;

a burner pilot system having a first fuel oxygen depletion system including a first thermocouple and a first pilot nozzle, said burner pilot system also having a second fuel oxygen depletion system including a second thermocouple and a second pilot nozzle, and a fuel selector valve, said fuel selector valve being positionable between a first position allowing the passage of a first fuel through said fuel selector valve to said burner and to said first pilot nozzle and a second position allowing the passage of a second fuel through said fuel selector valve to said burner but preventing the passage of the second fuel through said fuel selector valve to either said first pilot nozzle or said second pilot nozzle.

2. The dual fuel heater of claim 1 wherein said first pilot nozzle and said second pilot nozzle are generally oriented perpendicular to each other.

3. The dual fuel heater of claim 1 wherein said selector valve is coupled to said control valve through a first pilot line segment extending between said control valve and a splitter and a second pilot line segment extending between said splitter and said selector valve, and wherein said second pilot nozzle is coupled to said control valve through said first pilot line segment and a third pilot line segment extending between said splitter and said second pilot nozzle.

4. The dual fuel heater of claim 1 further comprising a heat shield positioned between said first pilot nozzle and said second thermocouple.

5. A dual fuel heater comprising:

a regulator having a regulator fuel line inlet and a regulator fuel line outlet;

a flow control valve having a control valve fuel line inlet in fluid communication with said regulator fuel line outlet, control valve main line outlet, and a control valve pilot fuel line outlet;

a fuel selector valve having a selector valve pilot fuel line inlet in fluid communication with said control valve pilot fuel line outlet, a selector valve main line inlet in fluid communication with said control valve main line outlet, a selector valve pilot line outlet, and a selector valve burner line outlet, said fuel selector valve being positionable between a first position wherein a first fuel is directed to said selector valve burner line outlet and said selector valve pilot line outlet and a second position wherein a second fuel is directed only to said selector valve burner line outlet;

a burner in fluid communication with said selector valve burner line outlet, and a burner pilot system having a first fuel oxygen depletion system including a first thermocouple and a first pilot nozzle in fluid communication with said selector valve pilot line outlet, said burner pilot system also having a second fuel oxygen depletion system including a second thermocouple and a second pilot nozzle in fluid communication with said control valve pilot fuel line outlet, said second pilot nozzle being oriented to direct a flame to said second thermocouple, said first pilot nozzle being oriented to direct a flame to both said first the couple and said second pilot nozzle to maintain the second pilot nozzle in a lit condition.

6. The dual fuel heater of claim 1 wherein said selector valve pilot fuel line inlet and said second pilot nozzle are fluid communication with said control valve pilot fuel line outlet at least partially through a common pilot line.

7. The dual fuel heater of claim 1 wherein said first pilot nozzle and said second pilot nozzle are generally oriented perpendicular to each other.

8. The dual fuel heater of claim 1 wherein said selector valve pilot fuel line inlet is coupled to said control valve pilot fuel line outlet through a first pilot line segment extending between said control valve pilot fuel line outlet and a splitter and a second pilot line segment extending between said splitter and said selector valve pilot fuel line inlet, and wherein said second pilot nozzle is coupled to said control valve pilot fuel line outlet through said first pilot line segment and a third pilot line segment extending between said splitter and said second pilot nozzle.

9. The dual fuel heater of claim 1 further comprising a heat shield positioned between said first pilot nozzle and said second thermocouple.

10. A dual fuel heater burner pilot system comprising, a first fuel oxygen depletion system including a first thermocouple and a first pilot nozzle;

a second fuel oxygen depletion system including a second thermocouple and a second pilot nozzle;

said second pilot nozzle being configured to direct a flame to heat said second thermocouple;

said first pilot nozzle being configured to simultaneously direct a flame to heat said second thermocouple and maintain the ignition of said second pilot nozzle, and a shield positioned between said first pilot nozzle and said second thermocouple to restrict the heat from the flame of said first pilot nozzle from heating the second thermocouple.

11. The dual fuel heater of claim 10 wherein said first pilot nozzle and said second pilot nozzle are generally oriented perpendicular to each other.

* * * * *